US006793433B2

(12) United States Patent
Giraldo

(10) Patent No.: US 6,793,433 B2
(45) Date of Patent: Sep. 21, 2004

(54) TRAVEL TOOTHBRUSH WITH DENTAL CREAM INCLUDED

(75) Inventor: Juan David Giraldo, c/o 4982 Rustic Trail, Midland, TX (US) 79707

(73) Assignee: Juan David Giraldo, Midland, TX (US)

( * ) Notice: Subject to any disclaimer, the term of this patent is extended or adjusted under 35 U.S.C. 154(b) by 0 days.

(21) Appl. No.: 10/419,512

(22) Filed: Apr. 21, 2003

(65) Prior Publication Data

US 2004/0028456 A1 Feb. 12, 2004

Related U.S. Application Data

(63) Continuation-in-part of application No. 10/054,244, filed on Jan. 24, 2002, now abandoned.

(51) Int. Cl.[7] ..... A46B 11/04; B43M 11/06

(52) U.S. Cl. ..... 401/270; 401/183; 401/186

(58) Field of Search ..... 401/270, 183, 401/184, 186, 282, 175, 271–291

(56) References Cited

U.S. PATENT DOCUMENTS

| | | | | | |
|---|---|---|---|---|---|
| 2,900,650 | A | * | 8/1959 | Rivero | 401/183 |
| 5,028,158 | A | * | 7/1991 | Fey | 401/183 |
| 6,050,736 | A | * | 4/2000 | Gonzalez | 401/281 |

* cited by examiner

*Primary Examiner*—David J. Walczak
(74) *Attorney, Agent, or Firm*—Gary P. Topolosky

(57) ABSTRACT

A travel toothbrush through which dental cream may be dispensed one-handed. The toothbrush comprises a hollow, elongated handle; a cartridge in which dental cream is stored, this cartridge being sized to fit within the hollow handle; and a brush head portion having an aperture through which dental cream from the cartridge is dispensed within and beneath its brush head portion, when a pivotable valve in that brush head portion is moved to an open position by the operator's thumb or finger.

13 Claims, 3 Drawing Sheets

TRAVEL TOOTHBRUSH WITH DENTAL CREAM INCLUDED

RELATED DATA

This application is a continuation-in-part of application Ser. No. 10/054,244, filed on Jan. 24, 2002, now abandoned, the disclosure of which is fully incorporated by reference herein.

BACKGROUND OF THE INVENTION

The existing toothbrushes that we see on consumer shelves these days have undergone numerous modifications through the years. There are lots of new models in a big variety of brands, colors, sizes and features for attracting attract the attention of consumers. Likewise, dental cream, or toothpaste, has evolved since its very invention. Many substances have been added to such creams, including calcium, fluoride and "mfp", for attracting new consumers and keeping existing ones. Recently, a new product was marketed that is a combination of both dental paste and mouthwash.

Some companies have offered their customers a combination of two products, both toothbrush and dental cream, in one container for some time. Such models are typically suited for travel, and are often meant for disposal after all dental cream has been depleted therefrom. In other instances, the dental cream containment of a toothbrush "combination" is refillable. Representative of such prior art product combinations are the toothbrush/dental cream devices depicted in U.S. Pat. Nos. 64,455, 922,947, 1,374,330, 1,505,363, 1,780,066, 2,053,145, 2,997,078, 4,277,194, 4,583,563, 4,622,984, 4,717,278, 5,066,155, 5,181,531, 5,425,590, 5,439,014, 5,746,532, 5,911,532, 5,913,632 and 6,050,736. While a few components of my toothbrush/dental cream concept may have equivalents in several of the foregoing, I believe my invention as described below is a novel and non-obvious combination of features that represents an improvement over the prior art devices listed above.

My invention is yet another alternative to the foregoing collection of toothbrush and dental cream product combinations. I am introducing a revolutionary toothbrush with dental cream incorporated therein and delivered to the brush head by its user in a different manner from any of those above patented means. This invention has the potential to change the concept of teeth hygiene in my country with a portable design that is both functional and pragmatic.

I created this toothbrush/dental cream combination after conducting some research for its need in such big cities as Bogota, Barranquilla, Cali and Medellin, Colombia. Likewise, in such U.S. cities as Dallas and New York, the population of potential consumers that I targeted my invention for is very mixed and includes workers, students, homemakers and professionals from different social status levels.

With my new product design that incorporates small tubes of dental cream into the handle portion of a toothbrush, for application with only one hand by the user of this product, these two product forms (both toothbrush and dental cream/toothpaste) are again fused into one. My invention differs from conventional toothbrushes because its pen-like design makes it so portable that consumers could carry it around in their pockets, purses, etc., the same as they would a pencil or a pen.

I thank God for giving me the opportunity to create this invention for the well being of humanity.

BRIEF SUMMARY OF THE INVENTION

Past companies who intended to offer their consumers a combination of two products were, in fact, merely offering the customer two distinct products in one package (both toothbrush and dental cream). Based on that perception, I decided to create a unique and real product that the market has never seen before. I united two essential products for good oral hygiene in one resulting in an ergonomically designed toothbrush through which dental cream may be dispersed through a preferably, refillable cartridge. A significant advantage of my invention concerns the fact that dental cream may be dispersed onto the bristles of this toothbrush "one-handed", i.e. without the need to hold the brush in one hand and squeeze dental cream onto the brush with a second hand. Rather, the operation of this invention entails opening the button, or valve, that seals the dental cream cartridge when not in use, then squeezing said cream onto the bristle portion of my toothbrush.

Many of the prior art toothbrush/dental cream patents, identified above, required complex screw/auger or other mechanical means for supplying cream to the heads of their respective toothbrushes. My design, by contrast, is simple and can function single-handedly.

Alternative embodiments of this invention further include a cover for the brush head when not in use; and a clip device for easier carrying of my invention in the shirt pocket of any consumer. This toothbrush/dental cream configuration should also avoid the propagation of contagious diseases that are believed to spread due to the same dental cream package being shared among members of a determined group.

This toothbrush/dental cream combination has a valve for releasing and shutting off the flow of dental cream to the brush head, and preferably a brush head cover for protecting the bristles from virus or bacteria in the environment. The latter head cover also helps to avoid any dental cream from leaking when the consumer is carrying it in his/her pocket, jacket, bag, etc. The cartridge with dental cream is an integral part to the handle/body portion of this toothbrush design. This new product will be portable and pragmatic. It will save time and storage space for the average consumer, while also contributing to better teeth hygiene.

I hope to introduce a valuable product to the market that will also create a new concept in oral hygiene. I would find tremendous satisfaction in licensing this invention to any organization/manufacturer/corporate entity for transforming my concept from a prototype to a credible and profitable consumer item.

DETAILED DESCRIPTION OF THE INVENTION

Figure 1:
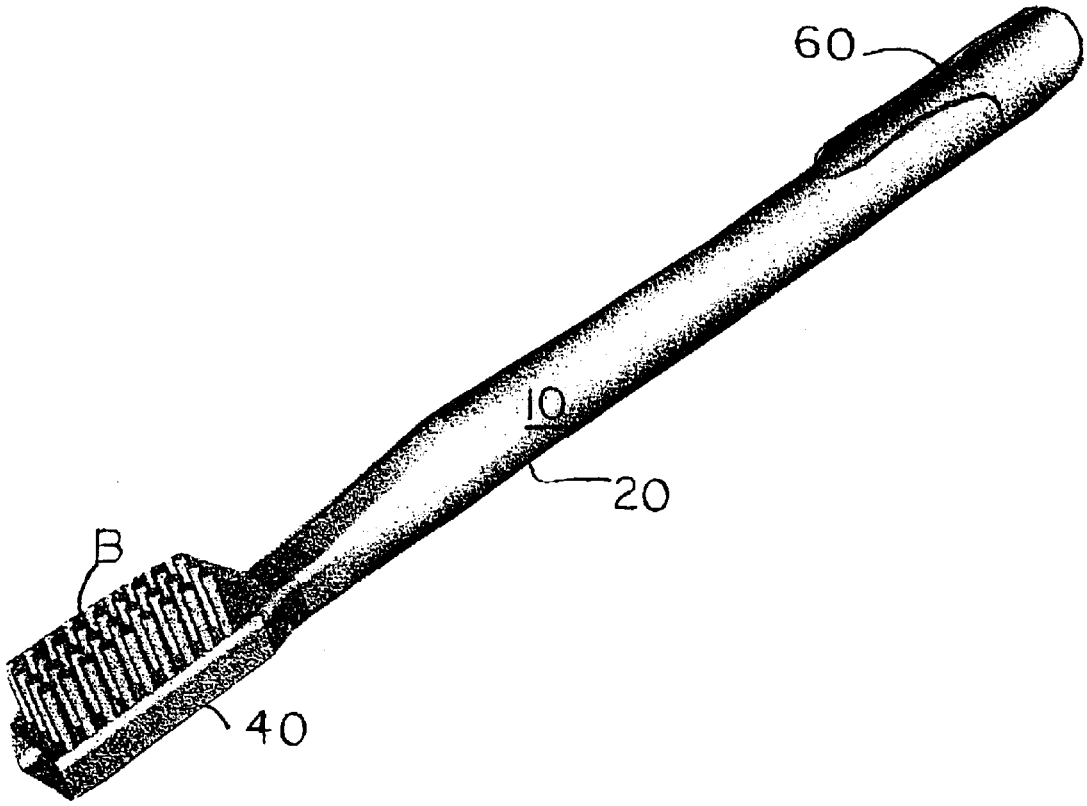
FIG. 1 is a perspective view of a fully assembled toothbrush and dental cream dispenser, with brush head cover removed, according to one preferred embodiment of this invention.

Referring now to the accompanying Figures, there is shown a toothbrush combination 10 consisting of a handle portion 20, refillable cartridge 30 and brush head portion 40, the latter portion 40 being unrotatably affixed to handle portion 20. In addition, within brush head portion 40, valve 50 is pivotally mounted for opening and closing means for delivering dental cream to brush head 40, preferably by being pushed into its open position merely using pressure from an operator's thumb or finger. Optionally, but also preferably, this invention further includes a clip 60 and brush head cover 70 (best seen in FIG. 2*b*).

Cartridge 30 extends from tip 32 through which dental cream is released via aperture 42 in brush head 40, along shaft 34 and ending in refilling end 36. The latter end 36, as shown, includes a threaded cap for securing into one end of shaft 34, though it is to be understood that other reusable filler ends are also anticipated hereby. In addition, less preferred embodiments of this invention could include a replaceable, disposable cartridge configuration as well. Ideally, this cartridge is made from highly flexible materials, plastic, cardboard or any other recyclable among them. More preferably, this material is clear, or substantially transparent for the user/operator to readily see how much dental cream remains in the cartridge. Harder components of this cartridge should insure that no dental cream will be wasted when cartridge 30 is installed into the handle 20 of this invention.

Tip 32 of cartridge 30 preferably contacts a ring 44 within brush head 40 when the refillable cartridge of this invention is properly installed within handle portion 20. More preferably, tip 32 will make a clicking sound to notify the user of this invention that cartridge 30 is now properly affixed within handle 20. Alternatively, cartridge 30 may be configured for inserting into handle 20 and with one or two rotations screwed into a threaded end of said handle for securing therein.

Handle 20 and cartridge 30 of this invention are ergonomically designed with handle 20 having a window 22 through which remaining contents of cartridge 30 may be monitored. Users of preferred embodiments of this invention apply dental cream to the bristles B of brush head 40 by first moving valve 50 to an "open" position as described in more detail below, then pressing a finger or thumb through window 22 and against cartridge 30. That, in turn, causes the dental cream within cartridge 30 to flow through tip 32, aperture 42 and onto bristles B. This cartridge is especially designed to prevent dental cream from leaking out the handle.

Figure 2A:
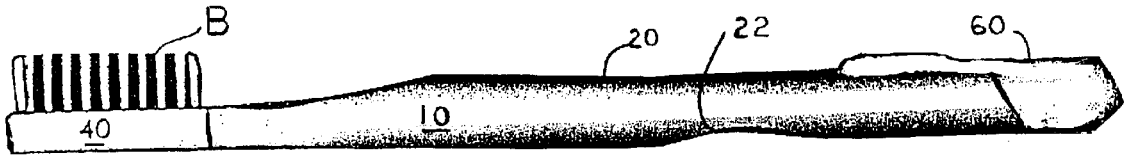
FIG. 2*a* is a side view of the fully assembled brush and cream dispenser from FIG. 1.
Figure 2B:
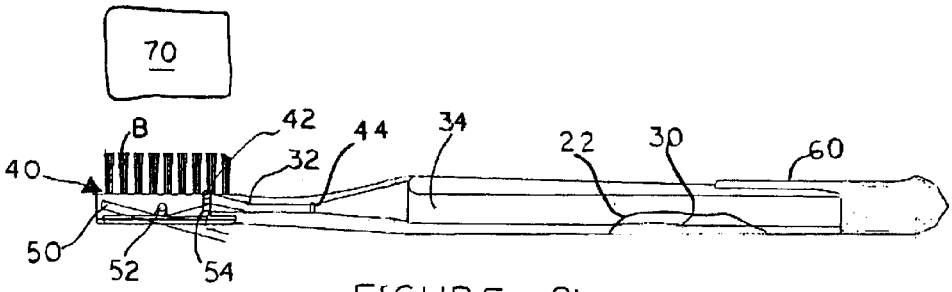
FIG. 2*b* is a sectional view of FIG. 2*a* showing the brush head cover and partially transparent portions of the brush head, for better illustrating the pivoting pin mechanism of this invention, and for showing the means by which the dental cream dispenser fits fully inserted into said brush head.
Figure 2C:
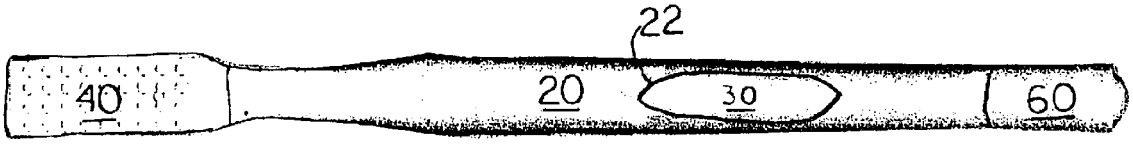
FIG. 2*c* is a bottom view of FIG. 2*a;*
Figure 2D:
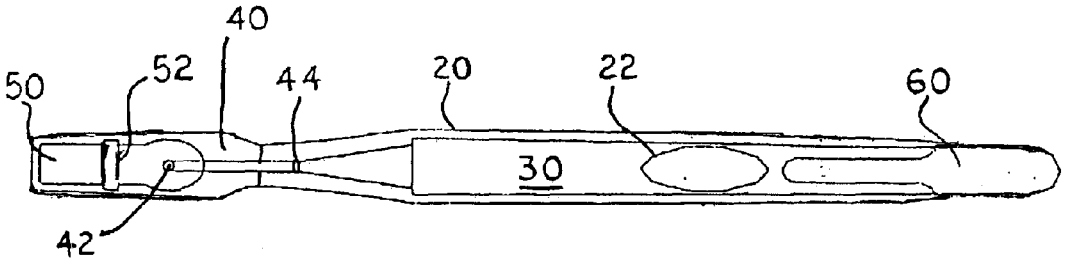
FIG. 2*d* is a sectional view of FIG. 2*c*, showing other aspects of this invention with partially transparent components.
Figure 3:
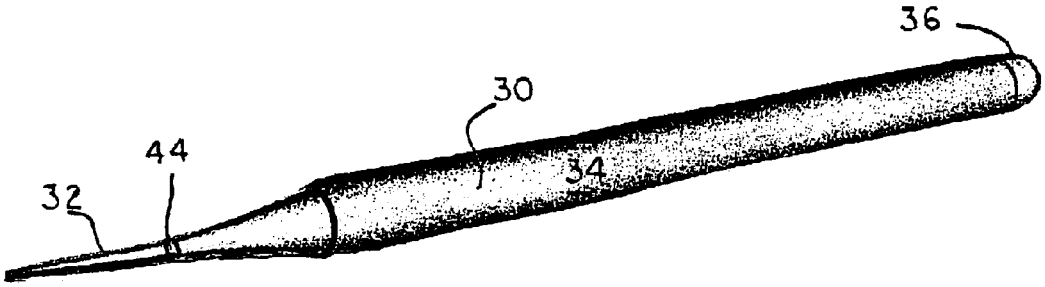
FIG. 3 is a perspective view of the dental cream dispenser portion of this invention.
Figure 4:
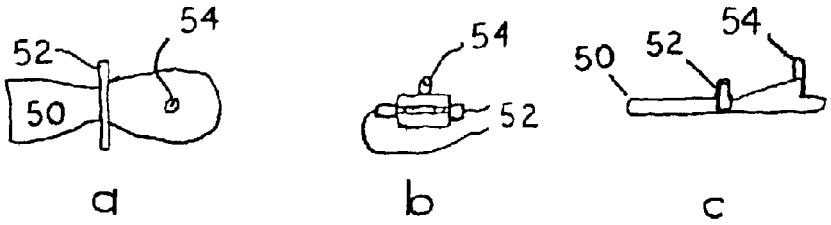
FIGS. 4*a* through *c* show the pivotal brush head component responsible for repeatedly sealing and resealing the dental cream within the handle portion of the toothbrush handle hereof. Particularly, this brush head component is shown in bottom view (4*a*), front view (4*b*) and side view (4*c*).

Valve 50, as shown in more detail in FIGS. 4*a* through *c*, serves as an interrupt to repeatedly release and seal the aperture through which dental cream will flow. Valve 50 should be made of a material with minimal elasticity so that little pressure is needed to move valve from a "closed" to an "open" setting, or vice versa. For this reason, preferred embodiments of valve 50 include a pair of side hinge pins 52 with a top pinhead-like protuberance 54 which opens or shuts aperture 42 in brush head 40. Most preferably, protuberance 54 is slightly inclined to ensure the aforesaid functional requirements. FIG. 2*b* shows valve 50 operating in both a closed and open position. When closed, the lower right side of valve 50, as depicted in FIG. 2*b*, is pushed inward until substantially flush with the bottom of brush head 40. To open this valve, nominal pressure is applied to its left side (as shown), causing valve 50 to pivot inwardly on hinge pins 52, after which the handle and cartridge are squeezed to dispense dental cream to the bristles B of brush head 40. Preferably, valve 50 is sized so that it must be in a closed position to fit in the user's mouth.

Pocket clip 60 should also be made of an elastic material while optional cover 70 may be made with 3 or 4 side walls, and with or without notches in at least one of these side walls for positioning over brush head 40 when the invention is not in use.

Having described currently preferred embodiments of this invention, it is to be understood that it may otherwise be shown and described in the scope of the accompanying claims.

What is claimed is:

1. A travel toothbrush through which integrally stored dental cream may be dispensed with only one hand by an operator, said toothbrush comprising:

(a) a hollow, elongated handle;

(b) a cartridge in which dental cream is stored, said cartridge being sized to fit within the hollow handle and end in a tip through which dental cream will be dispensed and having a threaded aperture and threaded cap opposite the tip for refilling;

(c) a brush head portion unrotatably affixed to one end of the handle, said brush head portion having an aperture adjacent to which the tip of the dental cream cartridge is located when said cartridge is properly positioned in said hollow handle; and (d) a pivotable valve for opening and closing the aperture in said brush head portion through which dental cream may flow when said valve is pushed to an open position, said dental cream being dispensed from within and beneath said brush head portion, through said aperture and onto said brush head portion by the operator without having to rotate said brush head portion relative to said handle or said cartridge.

2. The travel toothbrush of claim 1 which further includes a pocket clip for positioning over the handle.

3. The travel toothbrush of claim 1 which further includes a removable cover for storing over said brush head portion when not in use.

4. The travel toothbrush of claim 1 wherein said handle has a window through which the amount of dental cream in said cartridge can be seen, said dental cream being dispensed by manually depressing on said cartridge with an operator's thumb or finger.

5. The travel toothbrush of claim 1 wherein said cartridge is made from a flexible material for dispensing dental cream therefrom by placing nominal pressure against a side of said cartridge.

6. The travel toothbrush of claim 5 wherein said flexible material is substantially transparent.

7. The travel toothbrush of claim 1 wherein said dental cream cartridge is not refillable but rather removed from the handle after being substantially depleted of dental cream and replaced with a second dental cream cartridge.

8. The travel toothbrush of claim 1 wherein the tip of said cartridge fits snugly into said handle by abutting a ring in said handle.

9. The travel toothbrush of claim 1 wherein said pivotable valve may be pushed into said open position merely using pressure from an operator's thumb or finger.

10. A travel toothbrush through which integrally stored dental cream may be dispensed with only one hand for use by an operator, said toothbrush comprising:

(a) a hollow, elongated handle;

(b) a cartridge in which dental cream is stored, said cartridge: being sized to fit within the hollow handle, ending in a tip through which dental cream will be dispensed; being made from a flexible material for dispensing dental cream therefrom by placing nominal pressure against a side of said cartridge; and having a threaded aperture and threaded cap opposite the tip for refilling;

(c) a brush head portion non-pivotally affixed to one end of the handle, said brush head portion having an aperture adjacent to which the tip of the dental cream cartridge is located when said cartridge is properly positioned in said hollow handle;

(d) a pivotable valve for opening and closing the aperture in said brush head portion through which dental cream may flow when said valve is pushed to an open position, said dental cream being dispensed from within and beneath said brush head portion, through said aperture, then onto said brush head portion by the operator without having to rotate said brush head portion relative to said handle or said cartridge; and (e) at least one of: (i) a pocket clip for positioning over the handle; or (ii) a removable cover for storing over the brush head portion when not in use.

11. The travel toothbrush of claim 10 wherein said handle has a window through which the dental cream cartridge can be seen and through which said cartridge can be manually depressed by an operator's thumb or finger.

12. The travel toothbrush of claim 10 wherein said dental cream cartridge is substantially transparent.

13. The travel toothbrush of claim 10 wherein said pivotable valve may be pushed into said open position merely using pressure from an operator's thumb or finger.

* * * * *